US008286691B2

(12) United States Patent
Benedetti

(10) Patent No.: US 8,286,691 B2
(45) Date of Patent: Oct. 16, 2012

(54) CASTING AND CONTINUOUS ROLLING METHOD AND PLANT FOR MAKING LONG METAL ROLLED PRODUCTS

(75) Inventor: Gianpietro Benedetti, Tricesimo (IT)

(73) Assignee: Danieli & C. Officine Meccaniche Spa, Buttrio (IT)

( * ) Notice: Subject to any disclaimer, the term of this patent is extended or adjusted under 35 U.S.C. 154(b) by 132 days.

(21) Appl. No.: 12/858,737

(22) Filed: Aug. 18, 2010

(65) Prior Publication Data

US 2011/0308757 A1 Dec. 22, 2011

(30) Foreign Application Priority Data

Jun. 22, 2010 (IT) ..... UD2010A0124

(51) Int. Cl.

| | |
|---|---|
| ***B22D 11/00*** | (2006.01) |
| ***B22D 11/12*** | (2006.01) |
| ***B22D 11/126*** | (2006.01) |
| ***B21B 1/46*** | (2006.01) |

(52) U.S. Cl. ..... 164/460; 164/471; 164/476; 164/263; 164/417; 29/527.7

(58) Field of Classification Search ..... 164/460, 164/476, 477, 417, 263, 269, 424, 471, 493, 164/507; 29/527.7, 33 C See application file for complete search history.

(56) References Cited

U.S. PATENT DOCUMENTS

| | | | | |
|---|---|---|---|---|
| 5,182,847 | A * | 2/1993 | Guse et al. | 29/527.7 |
| 5,542,165 | A * | 8/1996 | Coassin et al. | 29/33 C |
| 5,769,149 | A * | 6/1998 | Mertens | 164/418 |

FOREIGN PATENT DOCUMENTS

| | | |
|---|---|---|
| DE | 4017928 | 12/1991 |
| DE | 19524082 | 1/1997 |
| EP | 0625383 | 11/1994 |

* cited by examiner

*Primary Examiner* — Kevin P Kerns

(74) *Attorney, Agent, or Firm* — Hamre, Schumann, Mueller & Larson, P.C.

(57) ABSTRACT

A method and plant for making long metal rolled products, in which a continuous casting is provided by a single casting machine, defining a casting axis, to cast a product with a quadrangular or equivalent section, a reduction of the section in a rolling mill defining a rolling axis substantially coinciding with the casting axis, and a selective accumulation and maintenance at temperature of a plurality of segments of cast product sheared to size in a misaligned position with respect to the cast axis and/or the rolling axis, inside a maintenance box furnace, for a time correlated to a condition of temporary interruption of the reduction step, so as to allow continuity of the continuous casting step.

10 Claims, 5 Drawing Sheets

CASTING AND CONTINUOUS ROLLING METHOD AND PLANT FOR MAKING LONG METAL ROLLED PRODUCTS

FIELD OF THE INVENTION

The present invention concerns a method and a plant for casting and continuous rolling in-line, in endless or semi-endless mode, so as to make long rolled metal products such as bars, wire rod, beams, rails or sections in general.

BACKGROUND OF THE INVENTION

Plants known in the state of the art for the production of long rolled products provide a casting machine and a rolling mill, which is disposed in line and downstream of the casting machine. It is also known that, in the solutions in which the casting axis defined by the casting machine and the rolling axis defined by the rolling mill coincide, the plant can be configured and used in endless (or continuous) mode, or in semi-endless mode (that is, starting from segments of cast products sheared to size).

In these operating solutions, if the rolling mill stops, either accidentally, for example due to cobbles, or programmed, for example to change channels or change production, it is necessary to stop the rolling process, which also entails the interruption of the casting machine; moreover, if the rolling mill stops accidentally it makes it necessary to scrap at least part of the intermediate material between the casting and the stopping point, and also the material being processed from the tundish to the rolling mill.

Consequently, any stoppage of the rolling mill causes a reduction in productivity and the plant utilization factor, an increase in the management costs and they are the main cause of an increase in energy required.

One purpose of the present invention is therefore to achieve an in-line casting and continuous rolling process, endless or semi-endless, and to perfect a relative production plant which allows to manage the stopping of the rolling mill, substantially without interrupting the casting and therefore without loss of production and without penalizing the steel plant upstream.

Another purpose of the invention is to reduce to a minimum or eliminate the scrap material in emergency situations or during programmed stoppages and so completely recover the product which in these situations is temporarily accumulated in an intermediate point along the production line.

Another purpose of the invention is to exploit to the utmost the enthalpy possessed by the original liquid steel along all the production line in order to obtain a considerable energy saving and a reduction in running costs compared with conventional processes.

Further purposes of the present invention are:

- to guarantee a higher yield, equal to the ratio between weight of the finished product and weight of the liquid steel to produce a ton,
- to obtain a greater stability of the rolling mill and a better dimensional quality of the finished product;
- to guarantee the possibility of changes in production in dimension and type without stopping the continuous casting, obtaining a higher plant utilization factor.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

A casting and continuous rolling plant for the production of long products according to the present invention comprises a single continuous casting machine and a rolling mill disposed downstream and in line with the casting machine. By disposed in-line we mean that a hypothetical casting axis of the casting machine is substantially coincident and parallel with a hypothetical rolling axis of the billets, and therefore this configuration is particularly suitable to make a process of the endless type; in any case it is always possible to achieve a process of the semi-endless type as well.

In some forms of embodiment, the casting machine has a crystallizer suitable to cast liquid steel at high speed and high productivity (for example, simply as an indication, from 35 up to 200 ton/hour). By high-speed casting we mean that the continuous casting machine can cast products, in relation to thickness, at a speed varying from about 3 to about 9 m/min.

Advantageously the crystallizer produces a substantially quadrangular section, hereafter defined generally as billets.

In the description and the claims, by the term billets we mean a product with a square section or a product with a substantially rectangular section or a widened form, in which the ratio between the long side and the short side is comprised between 1.02 and 4, that is, just higher than the square section up to a rectangular section in which the long side is up to 4 times longer than the short side.

In the present invention the section of the cast product is not limited to a quadrangular section with straight and two by two parallel sides, but also comprises sections with at least a curved, concave or convex side, advantageously but not necessarily two by two opposite and specular, or combinations of the aforesaid geometries.

When the crystallizer casts products having a rectangular section, a greater quantity in tons of material in a unit of time is obtained, given the same casting speed and thickness (or height) of the section, that is, an increase of the hourly productivity, for example higher than 120 t/h.

To give an example, the square billets which are produced by the continuous casting according to the present invention have dimensions variable between 100 mm×100 mm, 130 mm×130 mm, 150 mm×150 mm, 160 mm×160 mm or intermediate dimensions, while, to increase the productivity, the rectangular sections have dimensions variable between 100 mm×140 mm, 130 mm×180 mm, 130 mm×210 mm, 140 mm×190 mm, 160 mm×210 mm, 160 mm×280 mm, 180 mm×300 mm, 200 mm×320 mm or intermediate dimensions.

In general the cast section has a surface equal to that of a square with equal sides comprised between 100 and 300 mm.

When a metal product with substantially rectangular section is cast, an additional rolling unit is provided, consisting of at least one stand, so as to return the rectangle to a square/round/oval shape suitable for the rolling mill. The additional unit can be located immediately downstream of the casting machine, or immediately upstream of the rolling mill.

The casting and continuous rolling line also comprises, downstream of the continuous casting, at least a shears to shear the billets to size into segments of a desired length in the semi-endless mode or in an emergency case in the endless mode. By desired length of the segments we mean a value comprised between 12 and 18 meters.

Moreover the shears can carry out an emergency scrapping of the material coming from casting.

According to a characteristic feature of the present invention, downstream of the casting machine, and in a misaligned condition, or laterally offset, both with respect to the casting axis and also with respect to the rolling axis, there is a maintenance unit which includes a box furnace (or thermal box) configured to act as a chamber to maintain the temperature and accumulate billets, particularly but not exclusively in the event of a temporary interruption of the rolling mill, for example to allow programmed maintenance interventions or changes of channel or production, or for accidents.

In this way the casting machine does not necessarily have to be stopped, but only slowed down, inasmuch as the exiting product is sequentially cut into billets in predefined dimensions and is taken out of line, inside the box furnace, where it is substantially maintained at an operating temperature, thus unconstrained by the rolling mill which has stopped. The billets, accumulated and maintained at temperature, are then once again fed toward the rolling mill, once the operation of the latter has been restored. The billets are accumulated/discharged according to the LIFO criteria.

This solution allows to reduce, if not eliminate, losses in production in case of interruption of the rolling mill, greatly increasing the utilization factor and the yield of the plant; it is thus possible to reduce the running costs, to obtain a greater stability of the rolling mill and a better dimensional quality of the finished product, as well as to guarantee the possibility of changes in production in dimension and type without ever stopping the continuous casting.

Thanks to the box furnace, the overall yield is also improved; indeed, in the event of accidental interruption of the rolling mill during the continuous casting:

- steel which at the moment of the accident in the mill is to be found from the tundish (which loads the liquid steel into the crystallizer) at the beginning of the rolling mill does not have to be scrapped, nor the steel remaining in the ladle, which often cannot be recovered;
- in the event of an accidental blockage of the rolling mill, the billets already gripped in one or more stands can be returned inside the furnace and kept there, also at temperature, preventing any segmentation and therefore any loss of material.

The billets enter the box furnace at an average temperature of about 1100° C.; the average temperature of the billets at exit from the furnace is comprised between about 900° C. and about 1100° C.

The box furnace functions purely as a "maintenance chamber" in one of the following modes:

1) The load enters at 1100° C. and is maintained at 1100° C. (which means the temperatures in the furnace chamber are set at 1100-1120° C.), it is not necessary to have an inductor downstream of the furnace;
2) The load enters at 1100° C. and is maintained >900° C. (which means the temperatures in the furnace chamber are set at 920° C.-950° C.) in order to recover by means of an inductor, located immediately downstream, the rolling temperatures required.

In case 2) the box furnace has a gas consumption limited to what is necessary in order to maintain the box at a temperature lower than the load that enters into it.

In this way the consumption will oscillate from the working value to almost zero.

When the furnace is empty, the consumption is that needed to be ready and suitably hot.

On the other hand when the furnace receives (and immediately returns) a single billet at a higher temperature (which billet is allowed to lose temperature), then the consumption will tend to decrease according to how much heat the billet will lose, relatively to how much time the single billet stays inside.

If, on the other hand, the furnace accumulates a plurality of billets, then the consumption will tend to decrease to zero since in that transitory, the furnace is filled with a mass of iron that is hotter than when it exits from the furnace.

Advantageously, the accumulation capacity or buffer time of the box furnace is such as to contain a number of billets, in weight, equal to a ladle of steel of 70 tons.

As we said, in some solutions, not restrictive within the scope of the invention, at exit from the maintenance unit, or in any case downstream from it, there can be at least an inductor furnace which has the function of bringing the temperature of the billets to values suitable for rolling, at least when the temperature at which they exit from the furnace is about 1050° C. or lower.

The inductor furnace can be present, or also present, in an intermediate position between the stands of the rolling mill, and with its action allows a greater uniformity of heating of the billets, in particular to heat the edges, thus avoiding the formation of cracks in these zones during rolling.

In a preferred solution of the invention, the maintenance unit also comprises a rollerway connecting the casting machine and the rolling mill. In a first embodiment, the rollerway is located outside the box furnace, and the billets are feed toward the box furnace or discharge from it. In another embodiment the rollerway is located directly inside the box furnace According to another form of embodiment, the box furnace substantially comprises a front door for introducing/removing the billets into/from the furnace, in order to close the box furnace, a refractory furnace casing, a combustion apparatus with upper burners, or lower burners, or both upper and lower burners, and fumes removal from below to a natural or forced draught chimney, and a plurality of longitudinal members in fusion to support the charge that has accumulated inside the box furnace.

According to another form of embodiment, the box furnace comprises two lateral doors, for example one for introducing and one for removing the billets.

According to another form of embodiment, the plant comprises one or more thrust heads suitable to move the billets inside the box furnace, and also to feed and subsequently pick them up and re-deposit them on the rollerway.

Advantageously, one or more "counter-thrust" heads are provided, to empty the box furnace from the inside.

According to another form of embodiment, in place of the thrust heads, the box furnace comprises a plurality of longitudinal walking beams which are provided to move the billets.

According to one form of embodiment, the rolling line comprises one or more shears disposed immediately upstream of the rolling mill, or even in an intermediate position between the stands of the rolling mill, so as to be able to shear the cast product also during the rolling step, and feed it to the maintenance unit, in conditions when rolling is accidentally interrupted.

According to another form of embodiment, the rolling line comprises one or more, advantageously three, oxyacetylene cutting torches, possibly tracked, disposed between the shears for shearing to size downstream of casting and the cropping shears upstream of the rolling mill, and suitable to shear the cast product in the segment comprised between the shears into segments to be fed to the box furnace, in conditions when rolling is accidentally interrupted.

A rolling method for the production of long products also comes within the field of the present invention, comprising a step of continuous casting of billets, and a step of in-line rolling, subsequent to the continuous casting step, for the production of long rolled products.

According to a characteristic feature of the present invention, when the rolling step is interrupted, a step of accumulation and temperature maintenance is provided, which provides to accumulate a plurality of billets sheared to size, in an offset position from the casting and rolling axes, inside a box furnace in a temperature maintenance condition, for a time correlated to the intervention to restore rolling, so as to allow continuity of the continuous casting step.

The process thus provides to define an accumulation store between casting and rolling, with the time the billets remain there being equal to the time of the intervention to restore the rolling step.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF SOME PREFERENTIAL FORMS OF EMBODIMENT

Figure 1:
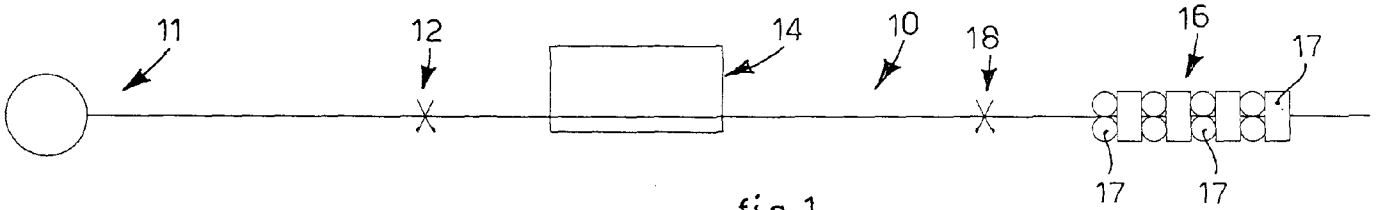
FIGS. 1-3 show three possible lay-outs of a rolling plant according to the present invention.

With reference to the attached drawings, FIG. 1 shows a first example of a lay-out 10 of a plant for the production of long products according to the present invention.

Figure 12:
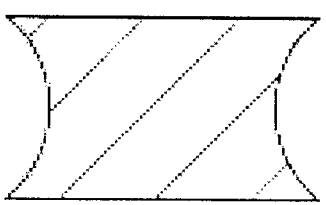
Figure 9:
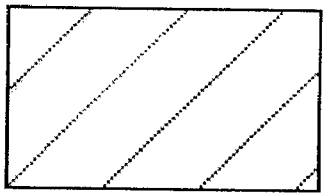
Figure 11:
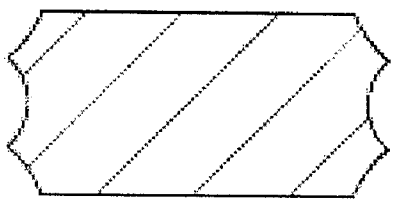

The lay-out 10 in FIG. 1 comprises, in the essential elements shown, a continuous casting machine 11 with one line only which uses a crystallizer or other device suitable to cast billets of various shapes and sizes, mostly quadrangular with straight, curved, concave or convex sides, or other. Some examples of sections that can be cast with the present invention are shown in FIGS. 9-12, which show respectively a rectangular section with straight and parallel sides (FIG. 9), a section with short sides with a convex curvature and straight and parallel long sides (FIG. 10), a section with short sides having a convex curvature at the center and with straight and parallel long sides (FIG. 11) and a section with short sides with a concave curvature and straight and parallel long sides (FIG. 12).

The continuous casting machine 11 is disposed on a line coinciding with the rolling line defined by a rolling mill 16 located downstream. In this way it is possible to achieve an endless process, that is, without any break in continuity. A semi-endless process may also be achieved.

In some forms of embodiment, the continuous casting machine 11 can be high-productivity, and can reach casting speeds comprised between 3 and 9 m/min, according to the type of product (section, quality of steel, final product to be obtained, etc.), and can also cast sections with a widened shape, that is, with one size prevailing over the other, in a ratio preferably comprised between 1.02 and 4.

In particular, the continuous casting machine 11 allows to obtain a productivity that varies from 35 ton/h to 200 ton/h.

Merely to give an example, the square cast billets are sized variable between 100 mm×100 mm, 130 mm×130 mm, 150 mm×150 mm, 160 mm×160 mm or intermediate dimensions, while, to increase the productivity, the rectangular sections have dimensions variable between 100 mm×140 mm, 130 mm×180 mm, 130 mm×210 mm, 140 mm×190 mm, 160 mm×210 mm, 160 mm×280 mm, 180 mm×300 mm, 200 mm×320 mm or intermediate dimensions. Generally, the cast section has a surface equal to that of a square with equivalent sides comprised between 100 and 300 mm.

Downstream of the continuous casting machine 11 there is a first shears for shearing to size 12, which can cut the cast billets into segments of a desired length, both for the functioning of the plant 10 in semi-endless mode and, as will be explained in detail hereafter, for the functioning of the plant 10 in endless mode, in the event of a stoppage of the rolling mill 16. The shears 12 can also perform an emergency scrapping operation of material arriving from casting.

If a rectangular section is cast, an additional reduction/roughing unit 13 may also be present (FIGS. 2 and 3), generally consisting of 1 to 4 rolling stands, and in this case, three rolling stands alternating vertical/horizontal/vertical or vertical/vertical/horizontal. It is also possible to use only a vertical rolling stand. The stands are used to return the cast section having a widened shape to a square, round, or oval section, or at least less widened that the starting section, in order to make it suitable for rolling in the rolling mill 16 located downstream. It is understood that the number of rolling stands can be chosen from 1 to 4, according to the overall design parameters of the line and products to be continuously cast.

The best position of the additional reduction/roughing unit 13 along the line comprised from the end of casting to the beginning of the rolling mill 16 is established in relation to the speed obtainable at entrance to the first stand of the unit. For example, if the speed is comprised between 3 and 4.8 m/min (0.05 msec and 0.08 m/sec), the reduction/roughing unit 13 is positioned immediately downstream of the continuous casting machine 11 and upstream of the shears 12 (FIG. 3), whereas if the speed at entrance to the stand is greater, for example comprised between 5 and 9 m/min, the additional reduction/roughing unit 13 is put at the head of the rolling mill 16 and downstream of the maintenance box furnace 14 (FIG. 2), as we shall see hereafter.

Another parameter that can condition the choice of inserting the additional reduction/roughing unit 13 immediately downstream of the continuous casting machine and upstream of the shears 12 is the energy factor.

In fact, when the first reduction in section is performed immediately downstream of the continuous casting, immediately after the closing of the metallurgic cone, energy consumption is reduced since the reduction in section takes place on a product with a core that is still very hot, and therefore it is possible to use a lesser force of compression and to use smaller stands that require less power installed.

Figure 2:
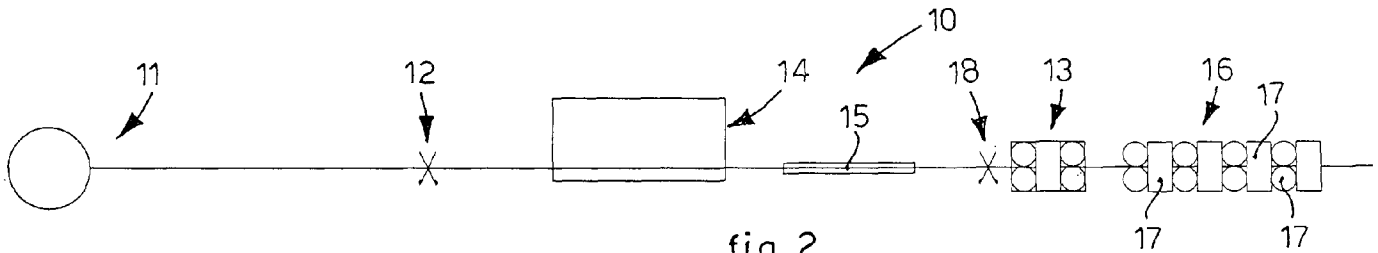
Figure 3:
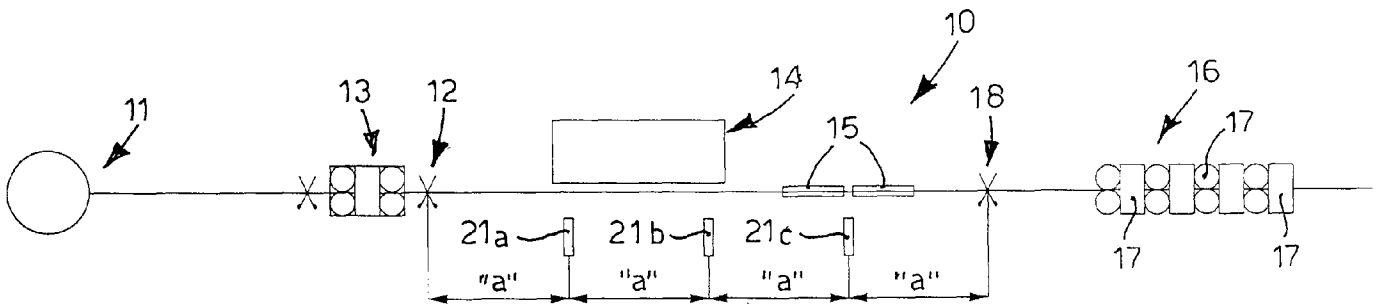

In the three lay-outs shown as examples in FIGS. 1-3, downstream of the continuous casting machine 11 a maintenance box furnace 14 is disposed, of the horizontal type, disposed misaligned or at least laterally offset with respect to the continuous casting line and the rolling line defined, respectively, by the continuous casting machine 11 and the rolling mill 16.

Figure 5:
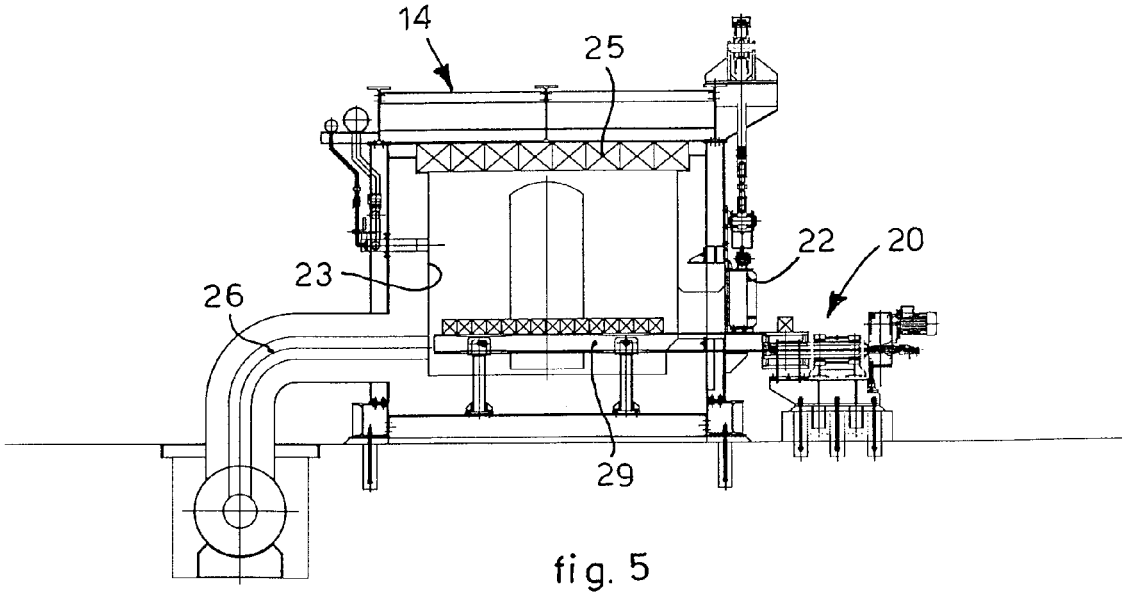
FIG. 5 shows a section from V to V in FIG. 4.

The box furnace 14 (FIG. 5) substantially comprises at least a front door 22 for introducing/removing the billets into/from the furnace, in order to close the box furnace 14, a refractory furnace casing 23, a combustion apparatus 25 with upper and lower burners, a plant to remove the fumes 26 from below and/or from above to a natural or forced draught chimney 27, and a plurality of longitudinal members 29, fixed, in fusion to support the load that has accumulated inside the box furnace 14.

Figure 4:
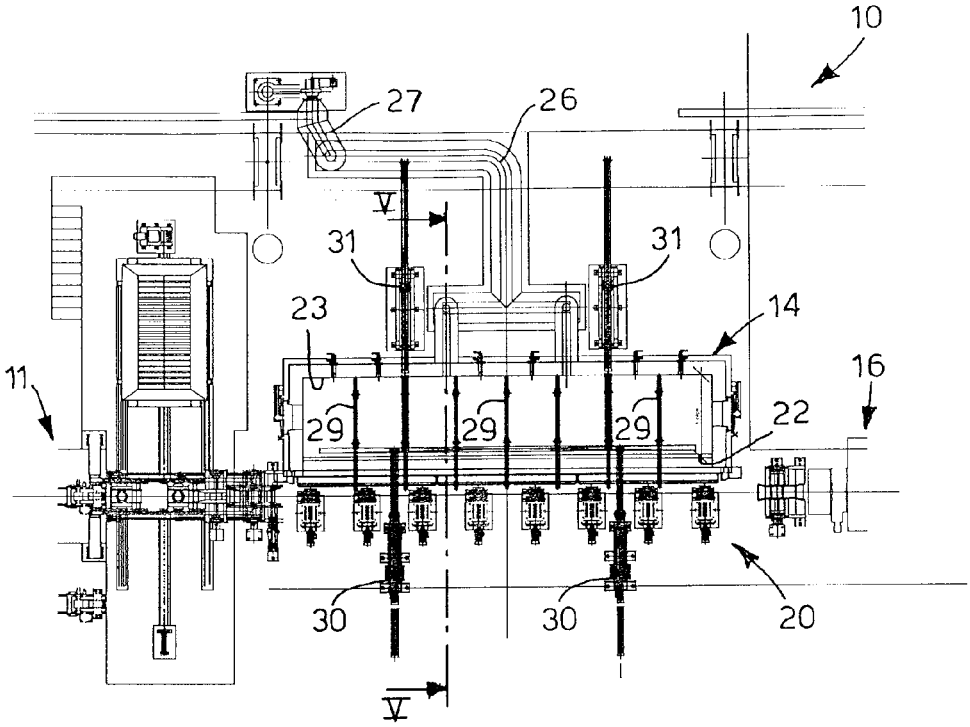
FIG. 4 shows an enlarged detail of one of the lay-outs in FIGS. 1-3.

Moreover, with particular reference to FIG. 4, the plant 10 comprises one or more thrust heads 30 suitable to feed the billets into the box furnace 14, and also to subsequently pick them up and re-deposit them on the rollerway 20.

Advantageously, one or more "counter-thrust" heads 31 are provided, conformed to empty the box furnace 14 from the inside.

The box furnace 14 functions mainly as an accumulation store for the billets, in particular in the event of an interruption in the functioning of the rolling mill 16, due to accidents or for a programmed roll-change or for change of production.

The box furnace 14 also functions as a maintenance chamber, keeping the temperature of the billets between entrance and exit, between about 900° C. and about 1100° C.

After the functioning of the rolling mill 16 has been restored, the billets accumulated and kept at temperature are sent to the rolling mill 16 according to predefined operating modes, re-establishing the normal functioning cycle of the plant 10.

Advantageously, the capacity of the box furnace 14 to accumulate billets, or so-called buffer, is such as to contain a number of billets which is equal in weight to a 70 ton ladle of steel.

In particular, the continuous casting machine 11 and the rolling mill 16 are connected to each other by means of a rollerway 20, provided substantially in correspondence with the box furnace 14.

Figure 6:
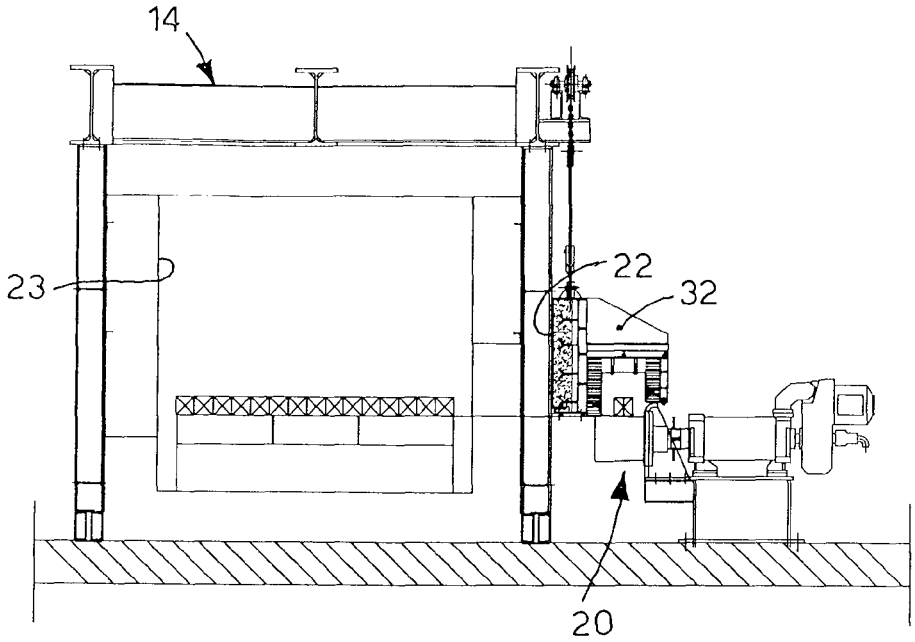
FIG. 6 shows a first possible variant of FIG. 5.

With reference to the form of embodiment given as an example in FIG. 6, above the rollerway 20, in association at least with the front aperture 22, a thermal cover 32 is provided, for example consisting of passive insulated hoods, which limits heat dissipation to a minimum, and hence limits the cooling of the billets in transit on the rollerway from the continuous casting machine 11 to the rolling mill 16, consequently saving energy.

Figure 7:
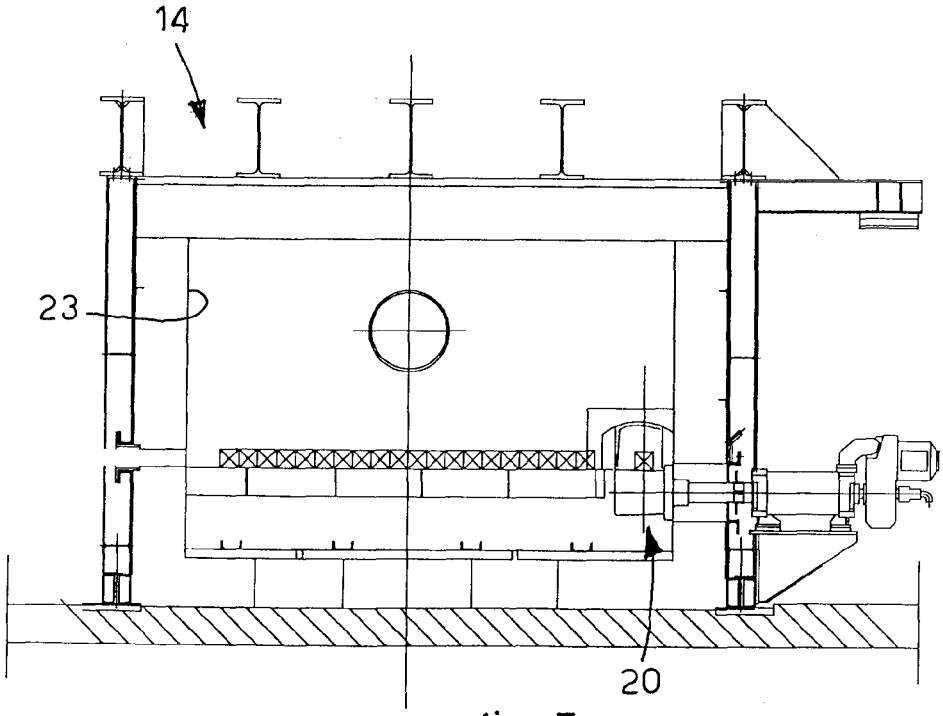
FIG. 7 shows a second possible variant of FIG. 5.

In the form of embodiment shown in FIG. 7, the furnace casing 23 of the box furnace 14 is conformed so as to house inside it the rollerway 20. In this form of embodiment the front aperture 22 is not provided, and in the normal working condition of the plant, the heat dispersions of the billet in transit on the rollerway 20 in the part that passes inside the box furnace 14 are further limited.

Figure 8:
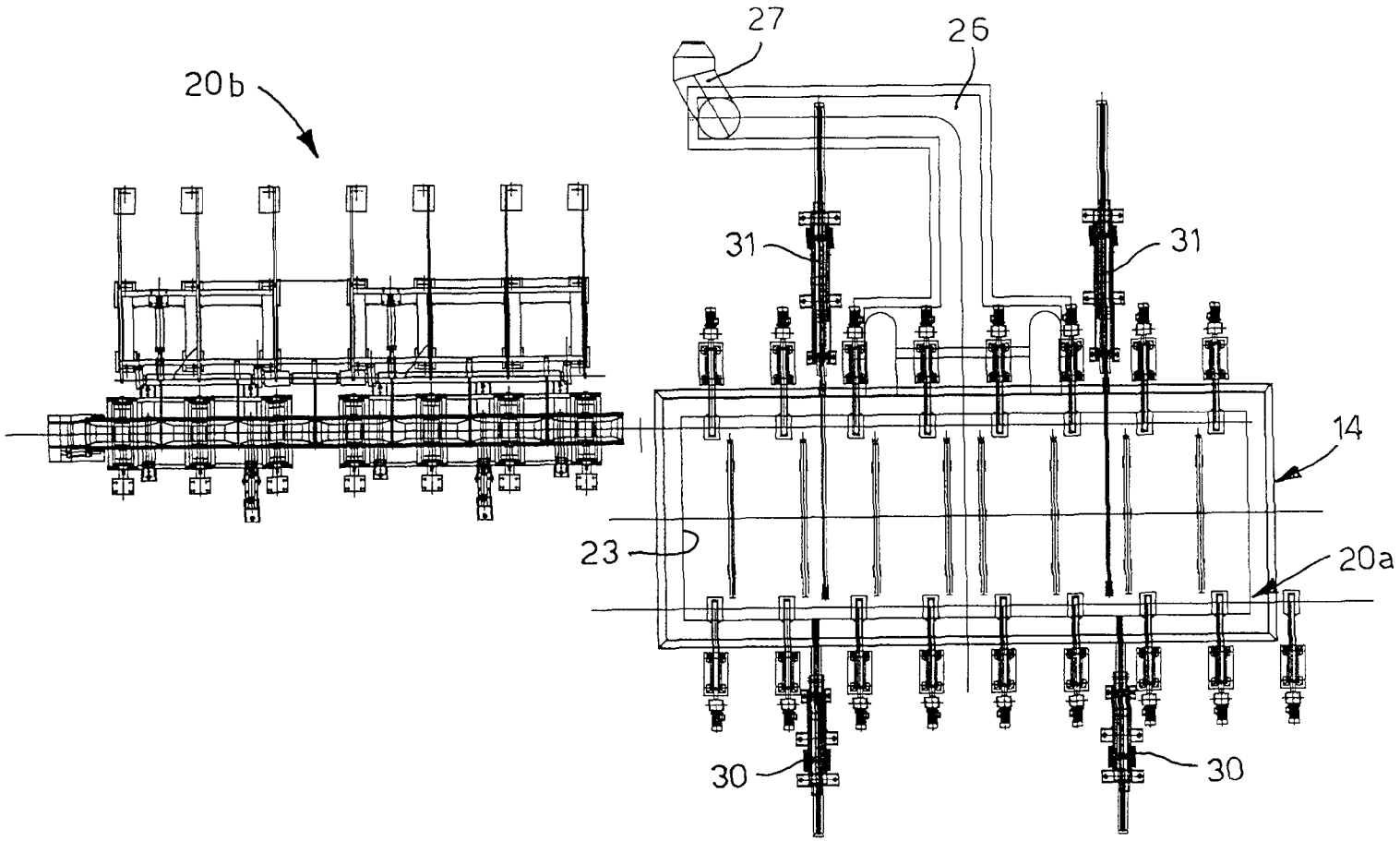
FIG. 8 shows a possible variant of FIG. 4.
Figure 10:
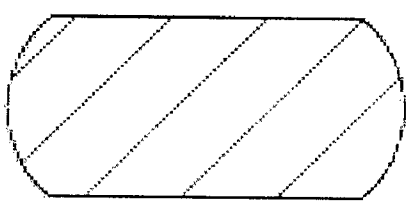
FIGS. 9-12 show examples of some of the different sections that can be cast with the plant in FIG. 1.

In the form of embodiment shown in FIG. 8, the furnace casing 23 of the box furnace 14 is conformed so as to house inside it two rollerways, respectively a first 20*a* aligned with the casting and rolling axes, and a second 20*b*, aligned with a possible discharge axis, substantially parallel to the casting and rolling axes. In this form of embodiment, in the condition where the stoppage of the rolling mill 16 lasts longer than the capacity of the buffer of the box furnace 14, in order not to stop the continuous casting machine 11, the billets are progressively discharged from the second rollerway 20*b* outside the box furnace 14 and out of the line, for example on a collection platform, to allow in any case to introduce inside the box furnace 14 new hot billets arriving from the continuous casting machine 11.

In this embodiment, the box furnace 14 could reprocess cast off billets with a heating at rolling temperature, or less.

The second rollerway 20*b*, parallel to the casting and rolling axes, to take out the billets, could be provided also for the embodiments as described with reference to FIGS. 4 to 7.

In the lay-out 10 shown in FIGS. 2 and 3, immediately downstream of the box furnace 14 and upstream of the rolling mill 16 an inductor 15 is provided, with the function of taking the temperature of the billets exiting from the box furnace 14 to values suitable for rolling, at least if the temperature at which they leave the furnace is about 1050° C. or lower. For example, when the billets are kept inside the box furnace 14 at a temperature comprised between about 920° C. and about 950° C., then the inductor 15 at exit from the box furnace 14 provides to restore the temperature to a value higher than about 1000° C., whereas if the billets are kept inside the box furnace 14 at a temperature comprised between about 1050° C. and about 1080° C., then it is not necessary to provide, or provide the function, of the inductor 15 at exit from the box furnace 14.

The number of rolling stands 17 used in the mill 16 varies from 3-4 to 15-18 and more, depending on the type of final product to be obtained, the thickness of the cast product, the casting speed and still other parameters.

Upstream of the rolling mill 16 there is a second cropping shears 18, for example a hydraulic shears, which not only crops the head of the billet before it enters into the stands of the rolling mill but can also carry out emergency scrapping operations.

In the form of embodiment shown in FIG. 3, the plant 10 comprises three oxyacetylene cutting torches 21*a*, 21*b*, 21*c*, disposed in correspondence with the rollerway 20, and mobile linearly and perpendicularly to the rollerway 20, by means of relative sliders, not shown. The oxyacetylene cutting torches 21*a*, 21*b*, 21*c* are configured to intervene simultaneously and to shear a continuous segment of billet, advantageously into four equal parts, indicated by the reference "a" in the lay-out in FIG. 3. To this purpose, the reciprocal positioning of the torches is equal to said distance "a" and also the distance from the shears 12 to the torch 21*a* and the distance from the torch 21*c* to the shears 18 are both equal to "a". Furthermore, the torches 21*a*, 21*b* are positioned substantially in correspondence with the ends of the front door 22 of the box furnace 14 so that the segment of billet cut by the torches has sizes such that it can be introduced directly inside the box furnace 14.

If the inductor 15 is provided in order to restore the temperature, it is advantageously made in two parts, or in two halves, as shown in FIG. 3, so that the torch 21*c* can have a free space to cut the billet in correspondence with the point of interruption.

For example, according to the embodiment shown in FIG. 3, if the plant is functioning in endless mode (that is, with the material simultaneously gripped in the continuous casting machine and the rolling stands) and an accidental stoppage of the rolling mill 16 occurs, the following emergency cycle is actuated:

- the shears 12 and the shears 18 cut the continuous segment of billet comprised between them;
- the casting machine is temporarily slowed down, for example halving the casting speed, and the shears 12 begins to scrap the material arriving from casting;
- the tracked oxyacetylene cutting torches 21*a*, 21*b*, 21*c* intervene simultaneously to cut the segment of billet into four equal parts, indicated with the reference "a";
- the segment of billet comprised between the torches 21*a* and 21*b* is the first to be thrust by the thrust heads 30 through the front door 22 inside the box furnace 14;
- subsequently the segments of billet comprised respectively in the segments 12-21*a*, 21*b*-21*c*, 21*c*-18 are taken by the rollerway (which makes them advance or retreat) in correspondence with the front door 22 of the box furnace 14 and then thrust inside by the thrust heads 30;
- the shears 12 stops scrapping and starts to cut to size the billets arriving from the continuous casting machine into segments of a predefined length (passage to semi-endless mode) which are thrust inside the box furnace 14 where they accumulate and are kept at temperature.

The billets unloaded and accumulated in the box furnace 14 during the periods when the rolling mill 16 is stopped are completely recovered, when it starts up again, and are re-introduced into the rolling line through the thrust heads 30, the counterthrust heads 31 and the rollerway 20.

Different modes may be provided to restart the billets, for example progressively, alternated with the billets arriving from casting, or in a single solution at the end of the casting production, for example, at the end of the day, or other. Another parameter of particular importance is the sharp reduction in the consumption of natural gas for feed to the box furnace 14, as much as ⅕, with respect to traditional solutions.

Other components known in the state of the art, such as de-scalers, measurers, etc., not shown, are normally present along the lay-out 10, present in the attached drawings.

The invention claimed:

1. A method for making long metal rolled products, comprising:

providing a continuous casting made by a single casting machine, defining a casting axis;

casting a cast product with a quadrangular or equivalent section, having a surface equal to that of a square with equivalent sides comprised between 100 and 300 mm;

performing a reduction of the section in a rolling mill defining a rolling axis substantially coinciding with the casting axis;

shearing the cast product to a plurality of segments; and performing selective accumulation and maintenance at a temperature of the plurality of segments of the cast product in a laterally misaligned position with respect to the casting axis and/or the rolling axis, inside a maintenance box furnace, having a containing capacity which is equal in weight to a 70 ton ladle of steel, for a time correlated to a condition of temporary interruption of the reduction step, so as to allow continuity of the continuous casting step, wherein when there is the temporary interruption, translating the segments of the cast product sheared to size in the maintenance box furnace along a substantially transverse direction with respect to the casting and rolling axis, by thrust heads which are movable along said substantially transverse direction, and then recovering the segments from the maintenance box furnace and re-introducing the segments into the casting and rolling axis according to a movement in inverse direction by the thrust heads or by counterthrust heads located on the opposite side of the maintenance box furnace with respect to the thrust heads.

2. The method as in claim 1, wherein said single casting machine operates at a casting speed between 3 and 9 m/min and an hourly production between 35 t/h and 200 t/h.

3. The method as in claim 1, further comprising a step of reduction/roughing of the cast product, carried out by an additional reduction unit including at least a rolling stand.

4. The method as in claim 1, further comprising a rapid heating step carried out by at least an inductor located immediately at an exit from the maintenance box furnace, and/or in an intermediate position between stands of the rolling mill.

5. A casting and continuous rolling line to make long metal rolled products, comprising:

a single-line continuous casting machine, defining a casting axis, able to cast a cast product with a quadrangular or equivalent section having a surface equal to that of a square with equivalent sides comprised between 100 and 300 mm;

a rolling mill defining a rolling axis substantially coinciding with the casting axis;

a maintenance box furnace disposed downstream and in a misaligned position, or laterally offset, with respect to the casting axis and/or the rolling axis, wherein a plurality of segments of the cast product, sheared to size, are able to be introduced so as to be accumulated in a condition of maintained temperature, in a misaligned position with respect to the casting axis and/or the rolling axis, for a time correlated to a condition of temporary stoppage of the rolling mill, without interrupting the functioning of the single-line continuous casting machine;

thrust heads movable according to a direction substantially transverse with respect to the casting axis and the rolling axis, to selectively translate the segments of the cast product cut to size in/from the maintenance box furnace according to said direction substantially transverse; and counterthrust heads located on an opposite side of the maintenance box furnace with respect to the thrust heads to recover the segments of the cast product cut to size from said maintenance box furnace and re-introduce the segments into the casting axis and the rolling axis according to a movement inverse to said direction.

6. The casting and continuous rolling line as in claim 5, further comprising;

first shearing means disposed downstream of the continuous casting machine, to shear to size the cast product into the segments of desired length; and second shearing means, disposed upstream of the rolling mill, to crop a leading end of the cast product before one of the segments of the cast product enters stands of said rolling mill.

7. The casting and continuous rolling line as in claim 5, further comprising an oxyacetylene cutting torch able to cut a continuous segment of the cast product positioned between said first and second shearing means into the segments suitable to be introduced into said maintenance box furnace.

8. The casting and continuous rolling line as in claim 5, further comprising an inductor furnace disposed at least at an exit from the maintenance box furnace, or in any case downstream thereof, and able to take the temperature of the segments of the cast product to values suitable for rolling.

9. The casting and continuous rolling line as in claim 5, further comprising a rollerway connecting the continuous casting machine and the rolling mill, said rollerway being located outside or inside the maintenance box furnace, so as to feed the segments of the cast product toward said maintenance box furnace, or to discharge them from said maintenance box furnace.

10. The casting and continuous rolling line as in claim 5, further comprising an additional reduction unit positioned between the exit of the casting machine and the entrance to the rolling mill, wherein the additional reduction unit includes a rolling stand.

* * * * *